US008551209B2

(12) United States Patent
Chanda et al.

(10) Patent No.: US 8,551,209 B2
(45) Date of Patent: Oct. 8, 2013

(54) METHOD AND APPARATUS FOR IMPROVED PROCESS CONTROL AND REAL-TIME DETERMINATION OF CARBON CONTENT DURING VACUUM DEGASSING OF MOLTEN METALS

(75) Inventors: Alak Chanda, Brampton (CA); Gervase I. MacKay, West Hill (CA)

(73) Assignee: Unisearch Associates Inc., Concord (CA)

( * ) Notice: Subject to any disclaimer, the term of this patent is extended or adjusted under 35 U.S.C. 154(b) by 223 days.

(21) Appl. No.: 13/272,405

(22) Filed: Oct. 13, 2011

(65) Prior Publication Data

US 2012/0266722 A1 Oct. 25, 2012

Related U.S. Application Data

(60) Provisional application No. 61/392,545, filed on Oct. 13, 2010.

(51) Int. Cl.
*C21C 7/10* (2006.01)

(52) U.S. Cl.
USPC ..... 75/10.12; 75/10.13; 75/10.64; 75/384; 75/386

(58) Field of Classification Search
USPC ..... 75/10.12, 10.13, 384, 386, 10.64
See application file for complete search history.

(56) References Cited

U.S. PATENT DOCUMENTS

| | | | | |
|---|---|---|---|---|
| 3,903,014 | A | 9/1975 | Baumert | |
| 4,251,269 | A * | 2/1981 | Hoshi et al. | 75/385 |
| 5,984,998 | A | 11/1999 | Ottesen et al. | |
| 6,787,776 | B2 | 9/2004 | Webber et al. | |
| 6,859,766 | B2 | 2/2005 | Von Drasek et al. | |
| 7,068,054 | B2 | 6/2006 | Chedid et al. | |
| 7,388,203 | B2 * | 6/2008 | Jannasch | 250/339.08 |
| 7,815,845 | B2 * | 10/2010 | Bruce | 266/94 |
| 8,353,194 | B2 * | 1/2013 | Reichel | 73/19.07 |

FOREIGN PATENT DOCUMENTS

| | | | |
|---|---|---|---|
| EP | 0881304 B1 | | 10/2002 |
| FR | 2835613 | * | 8/2003 |
| WO | 8901530 | | 2/1989 |
| WO | 9429488 | | 12/1994 |

OTHER PUBLICATIONS

"Infrared." Wikipedia. Wikimedia Foundation, Dec. 7, 2013. Web. Jul. 22, 2013. <http://en.wikipedia.org/wiki/Infrared>.*
Machine translation of FR 2,835,613 published Aug. 2003.*

* cited by examiner

*Primary Examiner* — Roy King
*Assistant Examiner* — Tima M McGuthry Banks
(74) *Attorney, Agent, or Firm* — Bereskin & Parr LLP/S.E.N.C.R.L., s.r.l.

(57) ABSTRACT

Methods and apparatuses for improved process control in metal smelting through measurement of off-gas profiles in real time. A tunable laser source is projected across a volume of off-gas and detected to provide a real time profile of gas concentrations. The real time gas concentration profile may be compared with known profiles to identify problems in the smelting process or to identify when the process is complete.

14 Claims, 8 Drawing Sheets

METHOD AND APPARATUS FOR IMPROVED PROCESS CONTROL AND REAL-TIME DETERMINATION OF CARBON CONTENT DURING VACUUM DEGASSING OF MOLTEN METALS

RELATED APPLICATION

This application claims the benefit of U.S. Provisional Application No. 61/392,545 filed Oct. 13, 2010 and is incorporated herein in its entirety by this reference to it.

FIELD

The embodiments described herein relate to a method and apparatus for improved process control in metal smelting and in particular to the measurement of off-gas during vacuum degassing.

SUMMARY

In one broad aspect, there is provided a method for degassing molten metal in a melt chamber, comprising: depressurizing the melt chamber to a substantially vacuum pressure; projecting a first portion of an optical beam generated by a laser source through a volume of gases evolved from the melt chamber, the volume of gases including at least one indicator gas; detecting the first portion of the optical beam after the first portion has passed through the volume of gases; projecting a second portion of the optical beam through a reference volume of gases, the reference volume of gases comprising the at least one indicator gas; detecting the second portion of the optical beam after the second portion has passed through the reference volume of gases; based on the detected first and second portions of the optical beam, controllably changing an output frequency of the laser source to substantially correspond with an absorption line of the at least one indicator gas; determining a real-time concentration of the at least one indicator gas based on the detected first and second portions of the optical beam; determining a process time for degassing, based on the real-time concentration; and re-pressurizing the melt chamber upon completion of the process time.

The first portion of the optical beam may be detected by an optical detector. The first portion of the optical beam may be focused on receiving optics, and the optical detector may be remotely positioned and operably connected to the receiving optics via an optical connector.

The method may comprise extracting the volume of gases evolved from the melt chamber into an external cell prior to detection.

The method may comprise reflecting the first portion of the optical beam across the volume of gases one or more times.

The volume of gases may be in a vacuum duct at low pressure or in a vacuum pump exhaust at ambient pressure.

The method may comprise disabling the laser source to measure background radiation and compensating for the measured background radiation.

The optical beam may be substantially in the near infrared wavelengths or in the mid infrared wavelengths.

The optical beam may be detected using non-dispersive infrared sensing or Fourier transform infrared spectrometry.

The method may comprise detecting a change in the real-time concentration corresponding to a predetermined profile indicative of a process control problem. The process control problem may be stirring gas injection nozzle clogging.

Further aspects and advantages of the embodiments described herein will appear from the following description taken together with the accompanying drawings.

DRAWINGS

For a better understanding of the embodiments described herein and to show more clearly how they may be carried into effect, reference will now be made, by way of example only, to the accompanying drawings which show at least one exemplary embodiment, and in which.

Figure 1:
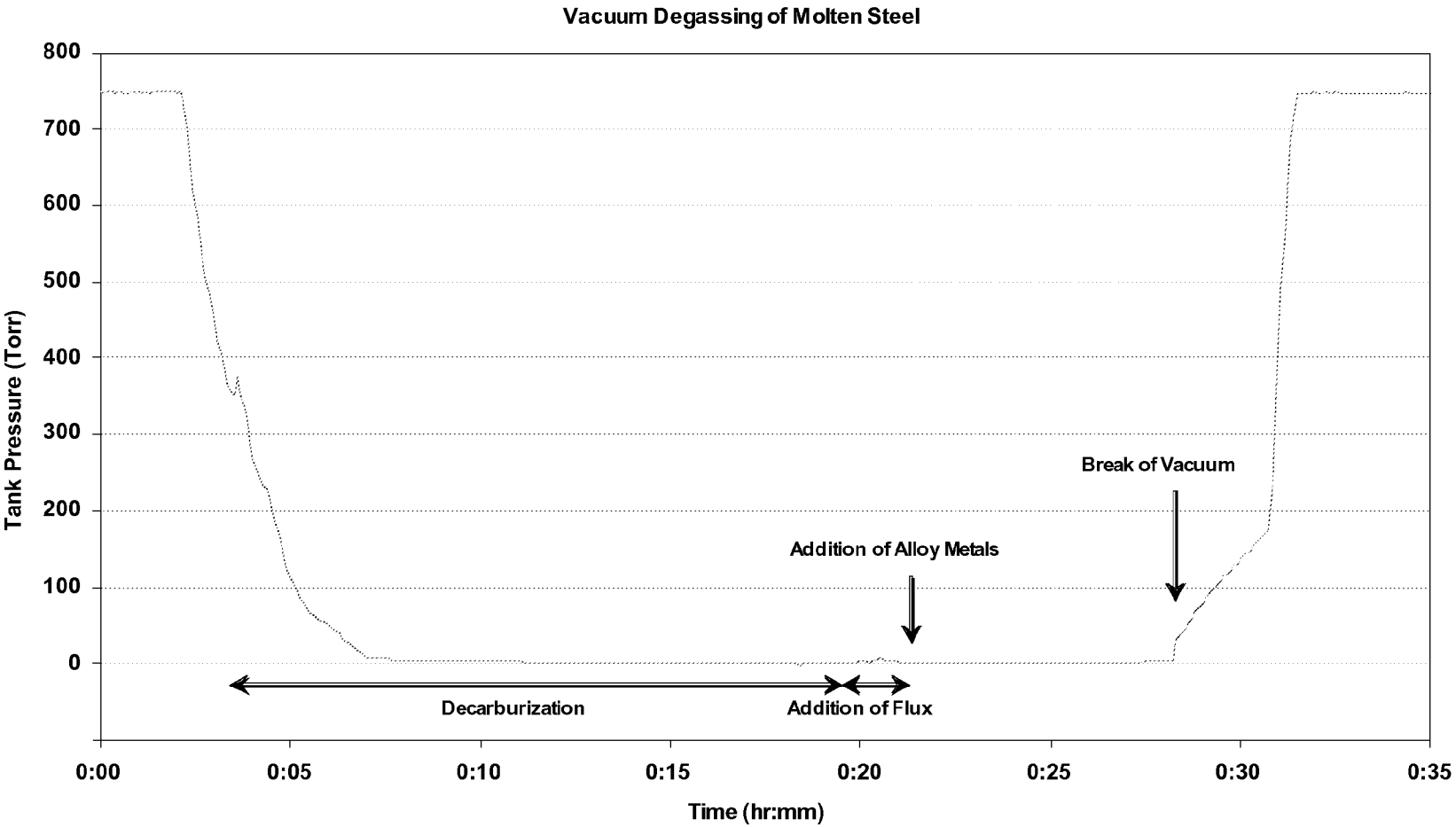
FIG. 1 is a time-pressure plot illustrating an example decarburization process.

The skilled person in the art will understand that the drawings, described below, are for illustration purposes only. The drawings are not intended to limit the scope of the applicants' teachings in anyway. Also, it will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF VARIOUS EMBODIMENTS

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementation of the various embodiments described herein.

In particular, for ease of exposition, embodiments are described herein with specific reference to the production of steel. However, it will be understood that the methods described herein are also applicable to the production of various other metal alloys and, in particular, to metal alloys that are produced with the use of vacuum degassing.

Metal alloys suitable for industrial or commercial use are typically formed by heating the constituent metals into a molten state and controllably adding alloying metals or other additives to obtain desired relative concentrations of the metals and various additives. In some cases, advantageous properties of the resulting metal alloy may be obtained by monitoring characteristics and contents of the product over time throughout the melt.

For example, to produce high-grade steels, molten steel may be subjected to low pressure or vacuum conditions for degassing to remove impurities including, but not limited to, carbon and oxygen, and other compounds. The carbon, in the form of carbon monoxide and carbon dioxide, compounds typically evolve during degassing of the molten metal in a low pressure or vacuum environment due to the presence of oxygen. In some cases, gases such as argon may be forced through the melt material to stir the material and accelerate the removal of carbon and/or other impurities. Argon is used since it is easily extracted from air. However, other inert gases may also be used.

The rate at which impurities are released from the melt material may be determined as a function of the temperature and pressure of the vacuum chamber, as well as the chemical composition of the melt material.

After degassing and prior to breaking the vacuum, other compounds such as manganese, silicon, and titanium may be added to the melt material to provide specific properties of the resulting steel.

Due to the high temperatures of the melt material, direct measurement of the carbon content of the steel is difficult to perform reliably. Direct measurement methods may also create the risk of introducing unwanted impurities into the melt material. Accordingly, existing processes for vacuum degassing of molten steel simply allow the degassing process to continue for a predetermined length of time, the length of time being determined empirically, to ensure with high probability that the desired carbon content has been reached.

Referring now to FIG. 1, there is shown a time-pressure plot illustrating an example decarburization process. At time 0:00, the molten material, which may contain high levels of carbon and other contents, is brought into a vacuum chamber. At this time the chamber is at ambient temperature and pressure. Between approximately time 0:03 and 0:07, the chamber is evacuated from 760 Torr (1 atmosphere) to approximately 5 Torr. Decarburization begins once the vacuum is introduced and continues for approximately sixteen minutes. During the degassing process, the molten material may be continuously stirred by the injection of argon or other suitable gases to expedite the decarburization process. At approximately time 0:19, flux material such as aluminum is introduced to the melt material. After a short mixing interval, alloying metals may be added and mixed further before the vacuum is broken at approximately time 0:28, to allow a sample to be taken for analysis.

With fixed degassing times, it is difficult to compensate for variations in temperature and pressure of the melt material or stirring effectiveness. Other operating parameters may also affect the degassing time. Such variations, if they can be properly determined during the degassing process, may be mitigated somewhat by using empirically determined degassing times that take into account the operating parameters. In some cases, however, it may be difficult to determine the optimum degassing times. For example, variations in steel and slag chemistry or problems with the stirring of the melt (e.g., due to clogged injection nozzles) may also induce variations in degassing time. Unless these variations are accounted for, they may result in the production of steel with incorrect specifications. Such unwanted steel may need to be stored, at additional expense, until a buyer is found. Recycling of such steel may not be possible due to the presence of additives.

Current vacuum decarburization techniques typically compensate for uncertainties by extending the empirically determined degassing times, to allow for variations. This is an added cost in terms of energy and production time. In addition, certain operating abnormalities may not be obvious to an operator. For example, clogged injection nozzles may be difficult to diagnose during degassing, resulting in improper stirring of the melt and lower quality of the steel.

Figure 2:
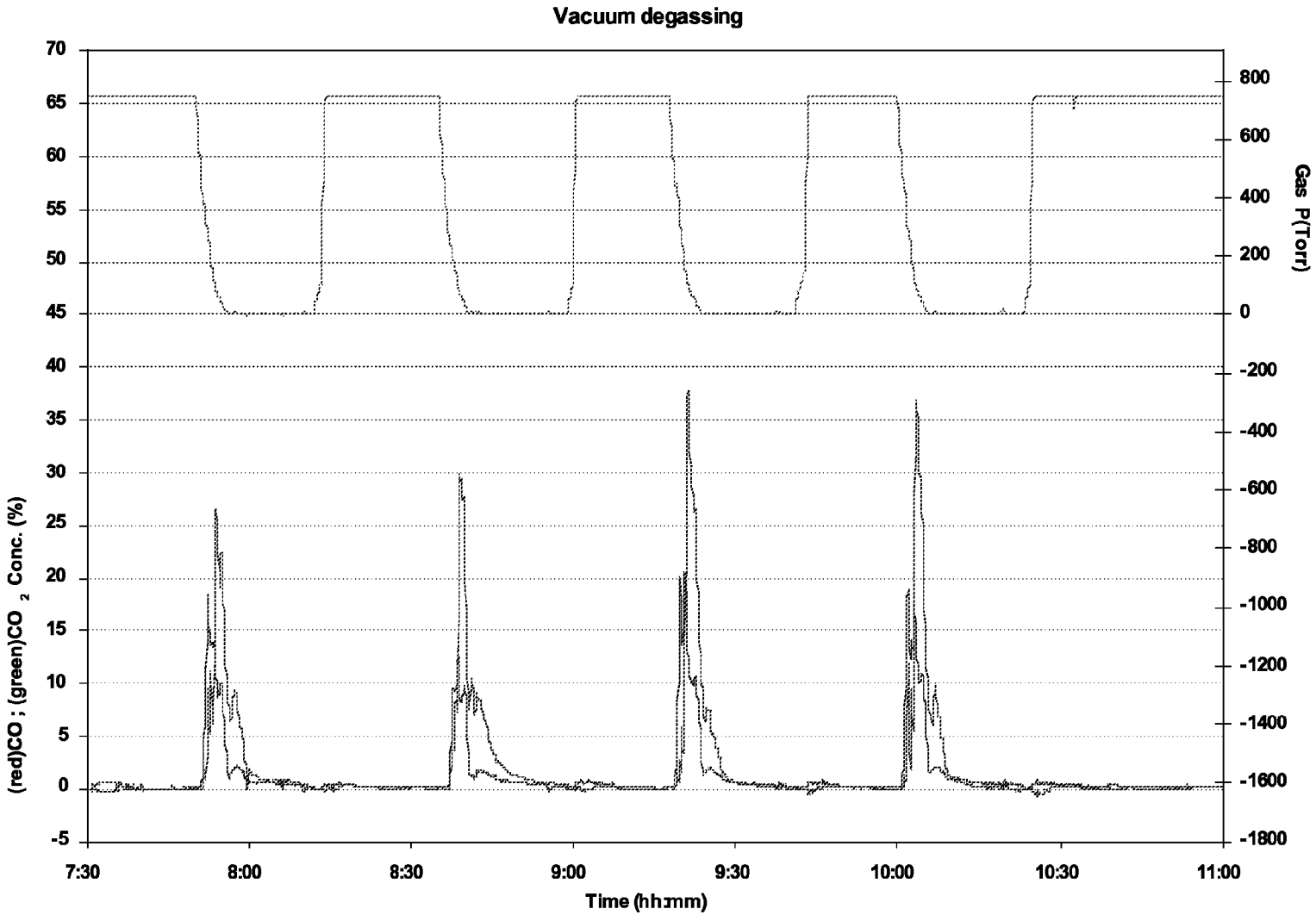
FIG. 2 is a plot of chamber pressure and gas concentrations over time.

Referring now to FIG. 2, there is shown a plot of chamber pressure and CO and $CO_2$ off-gas concentrations over time, obtained during vacuum degassing of molten steel. Reduction of carbon from the molten steel, in the presence of oxygen that is also emitted from the melt, results in the formation of carbon compounds such as CO and $CO_2$ gases. When carbon in the molten steel becomes depleted, the CO and $CO_2$ gas levels reduce correspondingly. FIG. 2 illustrates the CO and $CO_2$ gas levels in a vacuum line, which can be representative of the gas levels in the vacuum chamber itself.

Trace A illustrates the pressure in a melt chamber over a series of degassing operations. A degassing operation lasting approximately 20 minutes may be called a 'heat'. Trace B illustrates the concentration of carbon monoxide (CO) gas in the melt chamber. Correspondingly, trace C illustrates the concentration of carbon dioxide ($CO_2$) gas in the melt chamber. At time 7:50, the first degassing process begins. Pressure in the chamber is reduced until, at time 8:00, pressure is below 3 Torr. It can be seen from FIG. 2 that the largest volume of CO and $CO_2$ gas evolves while the pressure in the chamber is being reduced, and within the first 8-10 minutes. Once the pressure in the chamber has been reduced to approximately 2-3 Torr, the chamber is held at this pressure until approximately time 8:10, at which time the CO concentration in the chamber approaches zero. In this example, the vacuum period, in which pressure is held at 2-3 Torr, lasts for approximately twelve minutes to achieve a CO concentration close to zero. This includes the time used to add and mix additives to obtain a specific grade of steel. However, it can be seen that if a carbon content equivalent to a CO concentration of 1% is acceptable, the required vacuum period may be only eight minutes. Accordingly, still higher acceptable concentrations of CO would allow for even shorter vacuum periods.

Repetition of the above-noted procedure enables correlation of CO and $CO_2$ concentrations in the melt chamber over time with the carbon content of finished steel.

Figure 3A:
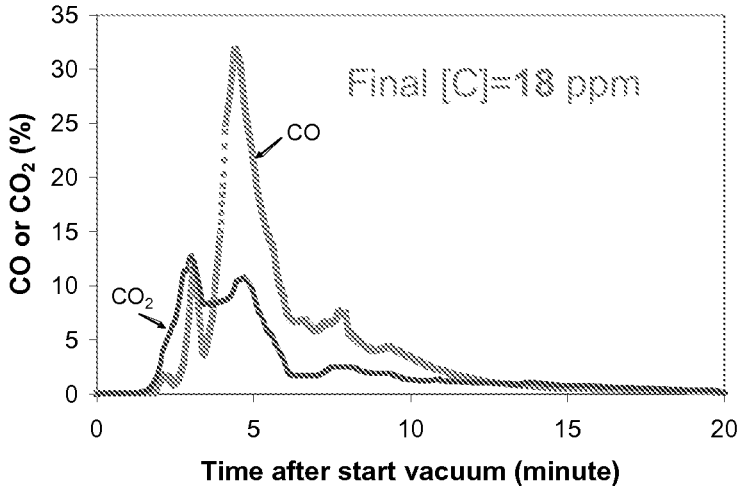
FIGS. 3A and 3B are plots of gas concentrations over time.
Figure 3B:
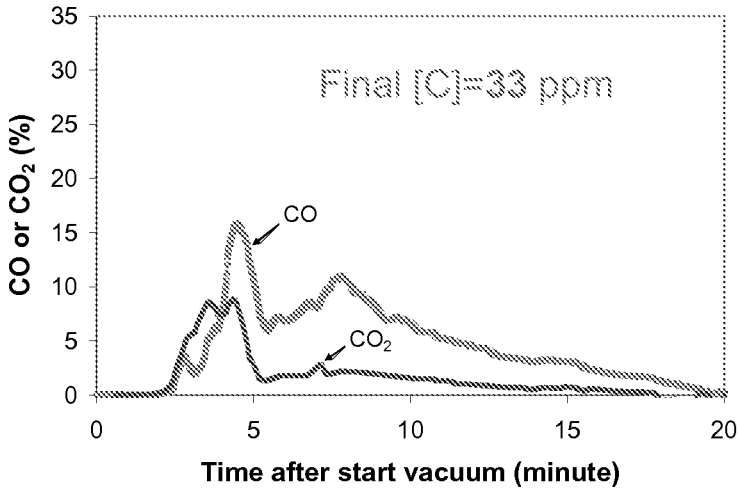

Referring now to FIGS. 3A and 3B, there are shown plots of gas concentrations over time. Both FIGS. 3A and 3B show concentrations of CO and $CO_2$ in exhaust gas from a melt chamber, following the start of the vacuum degassing process.

In FIG. 3A, the final carbon content after twenty minutes is 18 parts per million (ppm). However, in FIG. 3B, the final carbon content after the same twenty-minute period is 33 ppm. The variations in final carbon content may be attributable to a number of factors, such as temperature, steel chemistry, stirring gas injection and the like.

If, for example, a final carbon content of less than 25 ppm is desired, then the process shown in FIG. 3B would have produced unsuitable steel. To avoid such results, the vacuum degassing period might be further extended to maximize the probability that decarburization achieves the desired result. However, such an extended period is unnecessary in the case of the process shown in FIG. 3A. Accordingly, uniformly extending the degassing period across the board would result in inefficiencies and may still not achieve the desired results.

Moreover, in some cases, it may be desirable to produce steel with a specific carbon content range, as opposed to a maximum content. In such cases, extending the degassing period introduces the risk that degassing may "overshoot" the desired carbon content range, also resulting in unsuitable grade of steel.

Also, in some cases it may be desirable to monitor the presence of other gases and compounds in the melt chamber exhaust. For example, stirring gases are often injected into the melt chamber from the bottom of the chamber into the molten metal. However, stirring gas injection points can become clogged, substantially impacting the required process time. In such cases, the emitted off-gas profile will be substantially different as compared to when the process operates normally. Accordingly, by monitoring the emitted off-gas profile to identify, for example, the concentration of stirring gases, it is possible to determine if the process is operating as expected or if a fault condition has arisen. For example, a predetermined profile corresponding to stirring gas injection point clogging may be generated and used to compare with a normal process profile.

Referring again to FIGS. 3A and 3B, it can be seen that the CO and $CO_2$ gas concentration traces form specific emission profiles, which can be used for real-time process control. For example, the CO emission profile in FIG. 3A has a sharp, narrow peak with a quick decaying tail. In contrast, the CO emission profile in FIG. 3B is different and has a shorter, broader peak with a longer decay tail. Accordingly, it can be determined from this emission profile that FIG. 3B refers to a heat with improper stirring gas injection (e.g., due to clogged injection nozzles).

By measuring the off-gas exhausted from a vacuum chamber during vacuum degassing, and CO and $CO_2$ gases in particular, it is possible to correlate the carbon content of the steel to an emission profile in real time. Prediction of the carbon content in real time based on this correlation enables better control of the degassing process, based on expected and observed gas emission profiles, along with improved control and resolution of process problems as they occur. Knowing the time when the CO and $CO_2$ gas levels reach close to zero also enables an operator to optimize additive addition time and the vacuum break time.

The apparatus enables fast, real time measurement without disturbing gas chemistry in an interference-free, low maintenance manner. Accordingly, energy efficiency, storage requirements, product quality and productivity can be improved.

Figure 4:
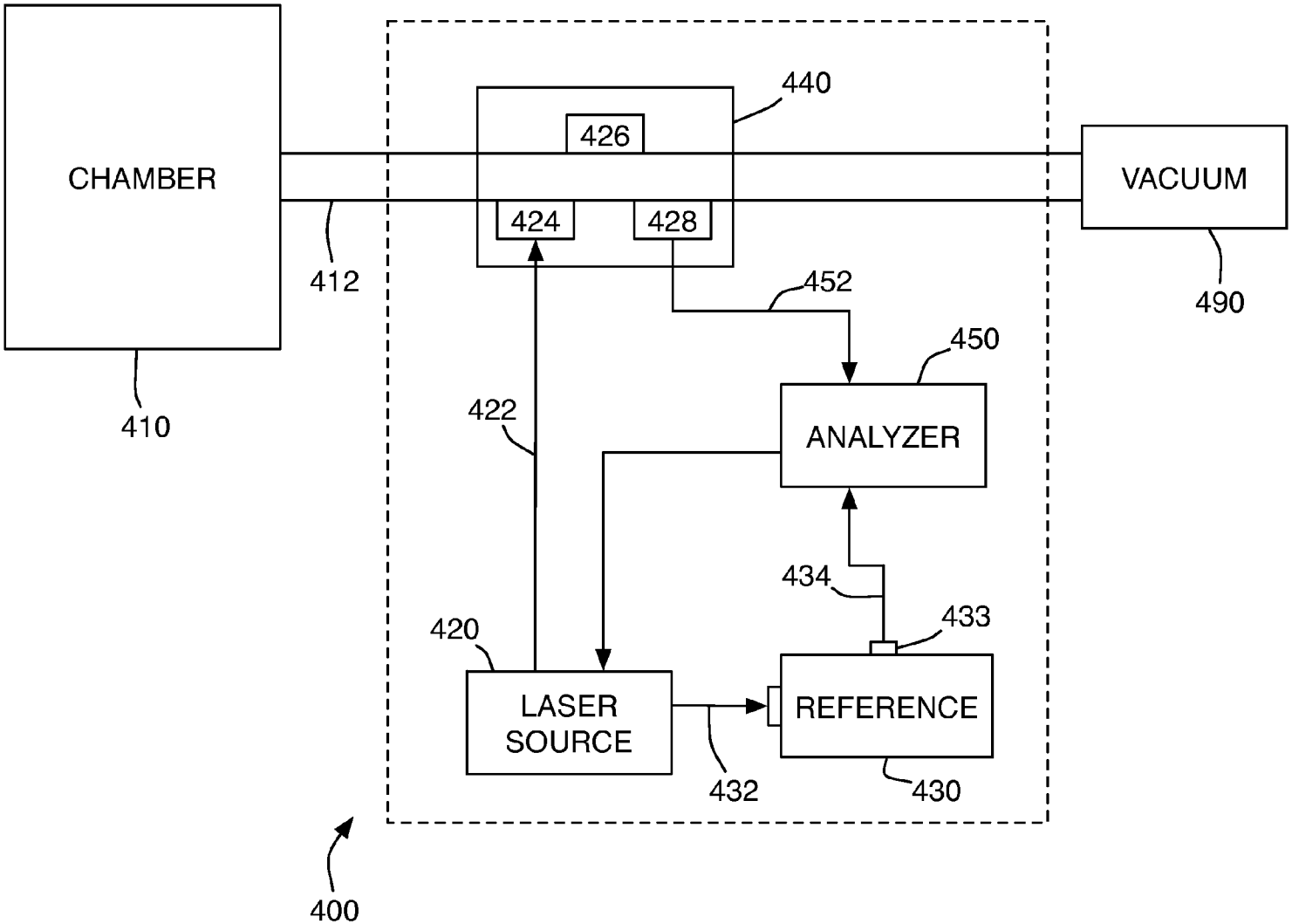
FIG. 4 is a schematic diagram of an exemplary apparatus.

Referring now to FIG. 4, there is shown a schematic diagram of an exemplary apparatus for real-time determination of carbon content during vacuum degassing. Apparatus 400 comprises a laser source 420, a reference cell 430, a detection enclosure 440 and data processor 450. Apparatus 400 may further comprise data storage, an operator display and operator controls (not shown).

Apparatus 400 may be operatively connected to an exhaust 412 of a melt chamber 410. Melt chamber 410 may be in fluid communication with a vacuum source 490, such as an exhaust pump, via exhaust 412. Exhaust 412 may be a duct for conveying exhaust gases evacuated from melt chamber 410. In some embodiments, exhaust 412 may be integral to melt chamber 410. Since exhaust 412 is between melt chamber 410 and vacuum source 490, pressure inside exhaust 412 will generally correspond with or be close to that inside melt chamber 410, when vacuum source 490 is enabled.

Laser source 420 may be a tunable diode laser (TDL). The TDL may also be provided with driver circuitry and associated electronics to control and tune the laser beam. The TDL may operate in the near infrared wavelength region or the mid infrared wavelength region. However, in some cases, the TDL may operate in other regions. In some cases, a distributed feedback (DFB) laser may be used. In some cases, the optical detector and laser source may be selected and configured to provide a nondispersive infrared sensor (NDIR). In some cases, the optical detector and laser source may be selected and configured to provide a Fourier transform infrared spectrometer (FTIR).

Generally, laser source 420 may be located sufficiently apart from melt chamber 410 and exhaust 412 to facilitate a lower operating temperature. However, detection enclosure 440 may be located in close proximity to melt chamber 410 and exhaust 412 and may therefore be exposed to high temperatures. Accordingly, laser source 420 may be located away from melt chamber 410 and operatively connected to detection enclosure 440 by a guide suitable to convey the optical beam produced by the laser source. For example, laser source 420 may be coupled to fiber optic cable 422, which has propagation characteristics that allow for the optical beam to be delivered with minimum losses. Use of fiber optic cables allows laser source 420 and the associated sensitive electronics to be remote from the harsh conditions, such as high temperature and dust, at the steel processing location. However, in some embodiments, a suitable heat- and dust-shielded enclosure may enable co-location of laser source 420 and detection enclosure 440.

Figure 7:
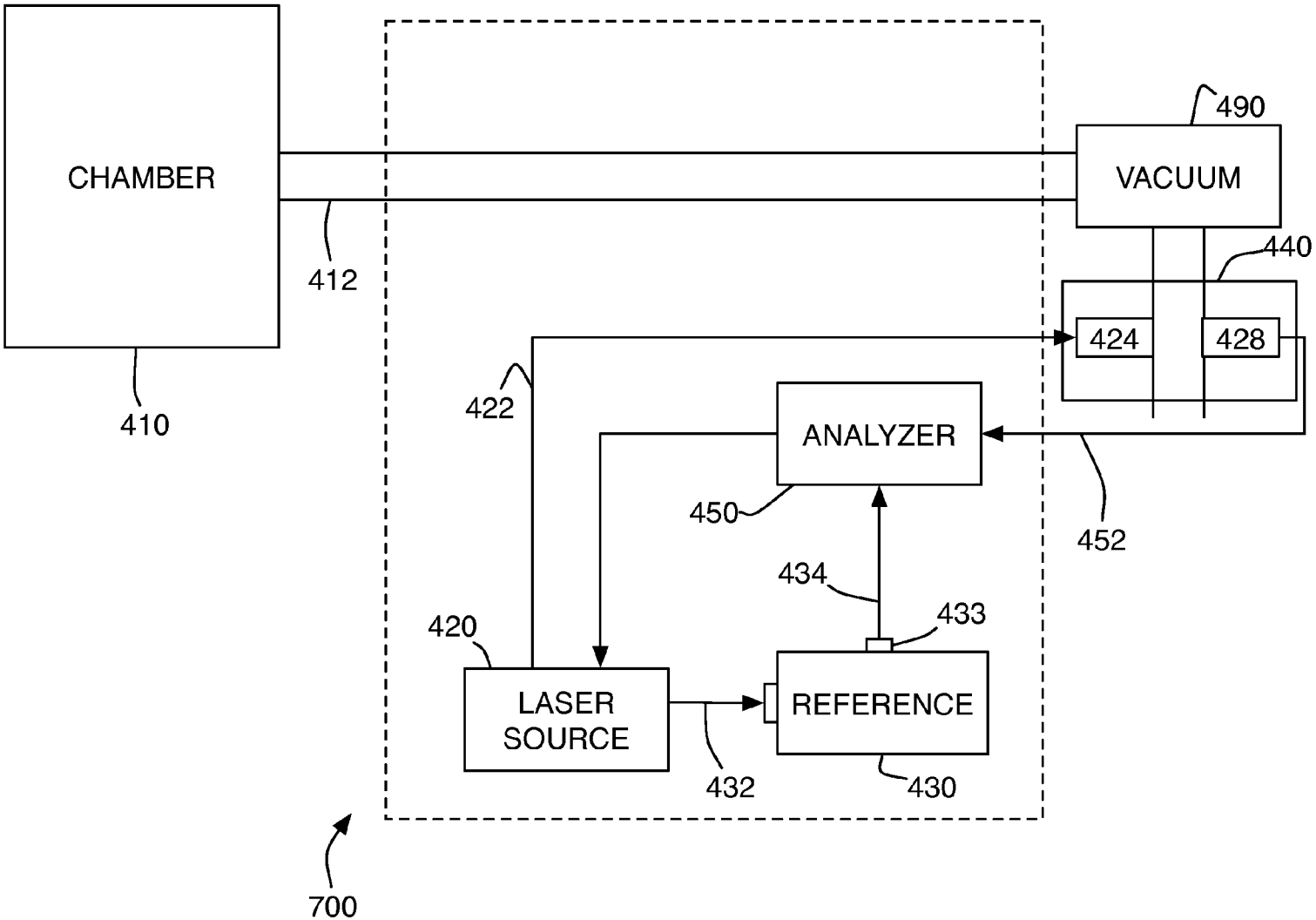
FIG. 7 is a schematic diagram of another exemplary apparatus.

Detection enclosure 440 can enclose a volume through which gases evacuated from melt chamber 410 pass. In some embodiments, such as those shown in FIGS. 4 and 5, detection enclosure 440 may be a portion of exhaust 412. In other embodiments, such as the embodiment shown in FIG. 7, detection enclosure 440 may not be in a portion of exhaust 412, and may instead be located at the exhaust of vacuum source 490.

The two locations for detection enclosure 440 differ in that gas pressure within exhaust 412 may be in the range from ambient to below 3 Torr. At low pressures, very few molecules may be left for measurement, and hence measurement sensitivity may be decreased. Conversely, gas pressure at the output exhaust of vacuum source 490 may be at or near ambient. Accordingly, measurement sensitivity may be higher at this location.

Enclosure 440 also comprises launching optics 424, such as a quartz or silica lens, the position of which is adjusted to project a collimated beam through a protective window made of suitable optically transparent material, such that the beam passes through a small aperture in the detection enclosure and across the volume space (path length). However, in some embodiments, launching optics 424 may allow for a variable focus beam, especially where alignment stability is of concern.

In an exemplary embodiment, the beam is projected through a portion of exhaust 412 via an aperture and window located on the exhaust means. The beam is projected to substantially traverse at least one full width (or height) of the exhaust means. To protect the interior surface of the window from dust and other particulates, argon or other suitable gas may be injected across the aperture.

The beam is collected and focused on an optical detector 428, the position of which is adjusted to receive the projected beam through a protective window made of suitable optically transparent material. Optical detector 428 receives the beam, converts the optical signal to an electrical signal and transmits the electrical signal to data processor 450 via a conductive cable 452, such as a coaxial cable. In some cases, it may be necessary to amplify the electrical signal prior to transmission. The signal may also be transmitted via another fiber optic cable.

As noted above, during vacuum degassing, the volume enclosed by detection enclosure 440 may be at substantially vacuum pressure, such as 5 Torr or lower. Accordingly, few molecules will be present in detection enclosure 440 to be detected. However, even relatively few molecules present at such low pressures can be detected using a laser source as described herein. Alternatively, measurements can be made at the exhaust of vacuum source 490, in which case the gas pressure may be close to ambient, resulting in improved measurement sensitivity.

In general, a longer path for the projected beam will maximize probability of the beam interacting with a molecule of interest. Accordingly, in some embodiments one or more reflectors 426 may be used to redirect the projected beam across the enclosed volume one or more times. Reflector 426 may be one or more mirrors, retro-reflectors or the like. The beam can be collected and focused on to optical detector 428. In some embodiments, a narrow-band optical filter may be placed in the receiving optical path to reduce infrared interference. In particular, spurious infrared radiation may emanate from hot gas, as well as surfaces of the detection enclosure 440.

Figure 5:
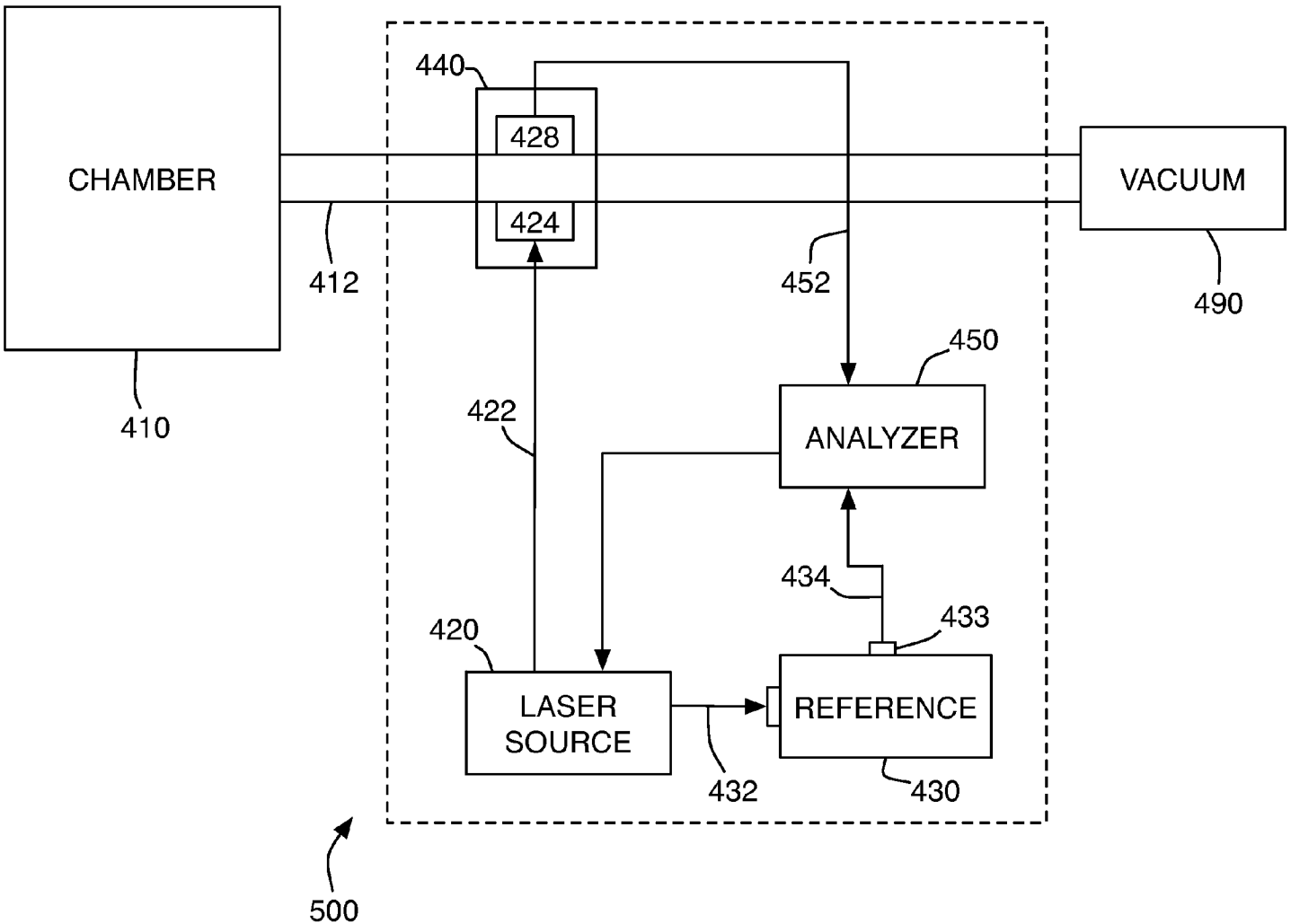
FIG. 5 is a schematic diagram of another exemplary apparatus.

Referring now to FIG. 5, there is shown a schematic diagram of another exemplary apparatus for real-time determination of carbon content during vacuum degassing. The apparatus 500 of FIG. 5 generally corresponds to the apparatus 400 of FIG. 4. However, apparatus 500 illustrates a single-pass configuration, in which reflector 426 is absent. Accordingly, the projected beam passes through detection enclosure 440 only once. In such embodiments, optical detector 428 may be positioned directly opposite launching optics 424 across detection enclosure 440, to reduce the path length of the projected beam.

In contrast, in apparatus 400, the projected beam passes through detection enclosure 440 more than once, due to reflection by reflector 426. In other embodiments, multiple reflectors may be used to reflect the beam across the detection enclosure 440 multiple times. Increasing the number of reflections can provide better measurement sensitivity. However, if dust or particulate loading is high, a single-pass configuration such as that shown in FIG. 5 may be preferable. A shorter path length may be desirable in cases where smoke or particulate matter severely attenuates the optical beam.

In still other embodiments, optical detector 428 may be positioned remotely from detection enclosure 440. In such cases, receiving optics in detection enclosure 440 may be provided, upon which the projected beam is focused. Accordingly, a fiber optic cable connected to the receiving optics may propagate the optical signal to optical detector 427, in like manner to optical fiber 422. This configuration may be useful where, for example, significant electrical noise in the vicinity of the melt chamber is expected, or where electrical codes specify explosion-proof equipment.

In yet another embodiment, the gas under measurement may be extracted into an external cell on which the optics are mounted to permit measurement of the gas composition. This configuration may be particularly useful in cases where a beam path across the detection enclosure 440 would be obscured either by structural materials or high dust levels, or simply for convenience.

Figure 6:
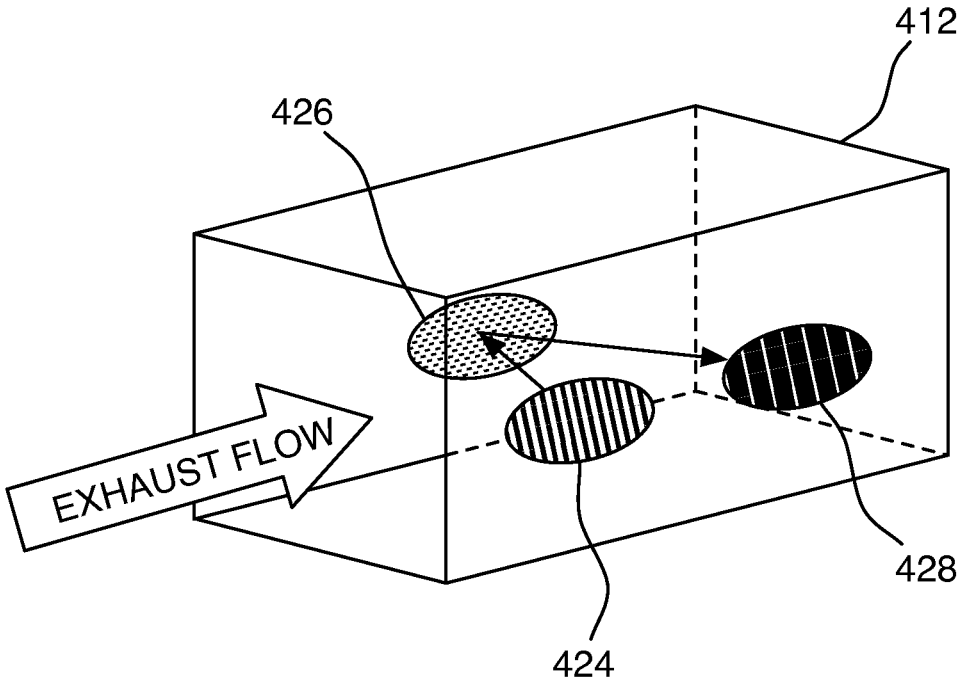
FIG. 6 is a perspective cut-away view of a detection enclosure illustrated in FIG. 4.

Referring now to FIG. 6, there is shown a perspective cut-away view of the detection enclosure 440 of FIG. 4. In the illustrated embodiment, the optical beam from laser source 420 passes through launching optics 424, traverses the detection enclosure a first time to impinge on reflector 426 and traverses the detection enclosure a second time to impinge on optical detector 428.

Referring again to FIG. 4, there is illustrated reference cell 430. To calibrate and control laser source 420, a portion of the outgoing laser beam from laser source 420 may be split off and directed to reference cell 430, which can be used to cross-check calibration if necessary. In an exemplary embodiment, 5% of the laser beam is redirected. The redirected portion may be altered as necessary, as long as it is sufficient to allow a clean reference signal to be generated. For example, a range between 2% and 10% may be used.

Reference cell 430 can be sealed and contain a known level of a gas or gases of interest, such as CO and $CO_2$, at a pressure similar to that expected in detection enclosure 440 during measurement. For example, the pressure inside reference cell 430 may be fixed at approximately 5 Torr or 10 Torr.

For variations in process gas T and P, real-time correction may be performed as described above.

The redirected portion of the laser signal may be passed through reference cell 430 and detected in similar manner as with detection enclosure 440. That is, a beam is projected through reference cell 430 and detected by reference detector 433 to produce a corresponding electrical signal.

Accordingly, the electrical signal from reference detector 433 is transmitted to data processor 450. Data processor 450 may comprise data acquisition and processing circuitry, and may use the electrical signal to control the diode laser temperature and current in such a manner that the output frequency of laser source 420 can be repetitively 'swept' over the absorption lines of the gases of interest, such as CO and $CO_2$. Since the laser wavelength changes depending upon the temperature and current applied to the laser device, the reference cell can be used to 'lock' the laser wavelength. The laser wavelength can be locked to a signal generated by from the reference cell.

After each sweep, laser source 420 may be momentarily disabled to allow any background infrared radiation to be measured and compensated for in subsequent signal processing.

Figure 8A:
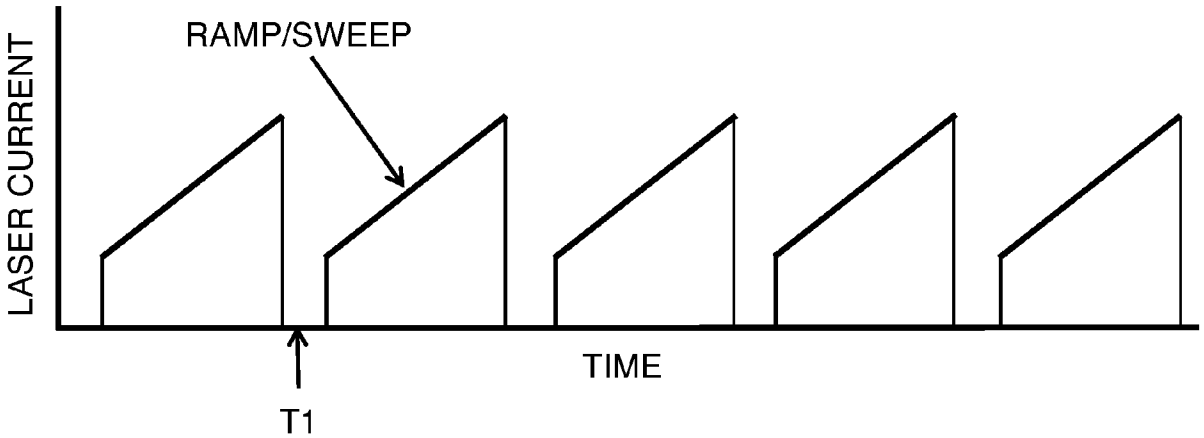
FIGS. 8A and 8B are plot diagrams of laser current with respect to time.
Figure 8B:
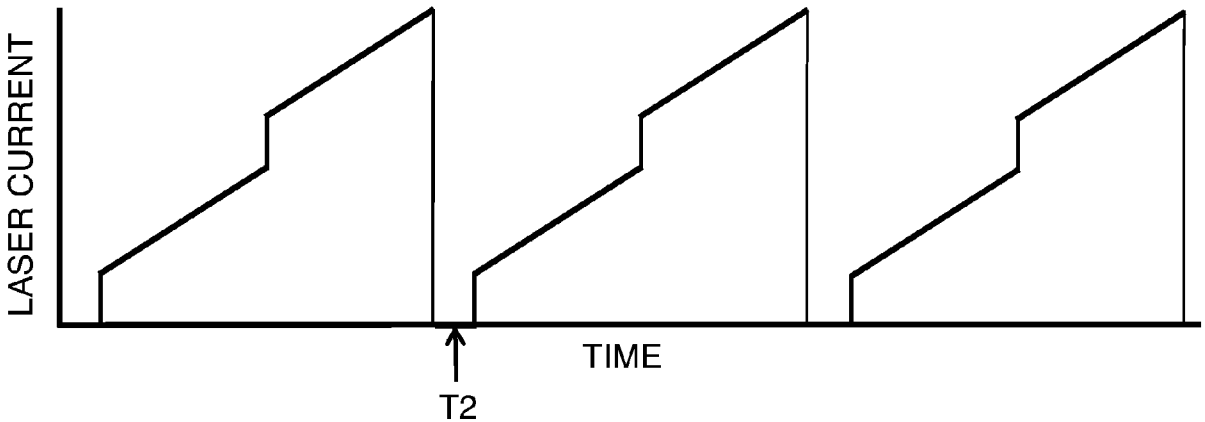

Referring now to FIGS. 8A and 8B, there are shown plots of laser current over time as current sweeps are performed. FIG. 8A illustrates a series of sweeps performed with only one gas measured (e.g. CO). FIG. 8B illustrates a series of sweeps performed with two gases measured (e.g. CO and CO2). It can be seen that periodically, during each sweep cycle, the laser current is turned off (resulting in no laser beam detected at the detector). If background infrared radiation is present (e.g., from hot gas), it can be detected during this "inactive" period. For example, background infrared radiation may be detected at time T1 in FIG. 8A and at time T2 in FIG. 8B. Subsequently, the measured background radiation can be subtracted from measurements made when the laser is activated.

As there may be significant and variable amounts of particulate matter in exhaust path 412, the signal level at the detector may be extremely variable. Accordingly, a fast automatic gain control may be provided in the signal processing chain to improve sensitivity (e.g., when transmitted light levels are low).

Referring again to FIG. 4, data processor 450 receives signals from each of detector 428 and 433 and processes the signals. In particular, data processor 450 processes the signal from reference detector 433 and, based on the reference detector 433 signal, processes the signal from optical detector 428 to determine a real-time concentration of each gas of interest in detection enclosure 440.

Data processor 450 may continuously measure and calculate real-time gas concentrations. Measurements may be integrated over time, for example in one to five second intervals, and corrected for temperature and pressure variations.

Processing of data to correct for gas temperature and pressure variations can also be performed. Accordingly, the gas temperature and pressure can also be measured and used for analysis. Software may correct for changes in gas temperature and pressure in real time.

In some embodiments, sensors or transducers may be provided at melt chamber 410 to provide indications of temperature and pressure to data processor 450. Data processor 450 may correct for changes to absorption coefficients due to changes in temperature and pressure. For example, modified absorption coefficients may be determined based on the sensed temperature and pressure by referring to previously calculated look-up or correction tables.

Measurements of CO and $CO_2$ concentrations may be repeated and combined with measurement data and related process information to develop an optimization algorithm. Specifically, variables such as gas concentration, temperature and pressure may be analyzed over time to determine an algorithm for producing a desired final carbon concentration in the steel. Accordingly, it is possible to halt the degassing process precisely when a desired concentration level is achieved. Moreover, by employing the optimization algorithm, the vacuum period between reaching the minimum pressure level and the subsequent addition of aluminum may be significantly reduced. This reduction in time allows extra 'heats' of vacuum degassing of steel to be performed in a day, with a corresponding increase in productivity.

After the additives are added and stirred, the vacuum can be broken. A sample may be taken and analyzed (e.g., in an automated process). Based on the analysis, an operator may decide further process steps to be performed. The processed metal may be taken out of the vacuum chamber, and poured or cast, as needed. New metals may then be introduced to the vacuum chamber and the process repeated.

Numerous specific details are set forth herein in order to provide a thorough understanding of the exemplary embodiments described herein. However, it will be understood by those of ordinary skill in the art that these embodiments may be practiced without these specific details. In other instances, well-known methods, procedures and components have not been described in detail so as not to obscure the description of the embodiments. Furthermore, this description is not to be considered as limiting the scope of these embodiments in any way, but rather as merely describing the implementation of these various embodiments.

The invention claimed is:

1. A method for degassing molten metal in a melt chamber, the method comprising:

depressurizing the melt chamber to a substantially vacuum pressure;

projecting a first portion of an optical beam generated by a laser source through a volume of gases evolved from the melt chamber, the volume of gases including at least one indicator gas;

detecting the first portion of the optical beam after the first portion has passed through the volume of gases;

projecting a second portion of the optical beam through a reference volume of gases, the reference volume of gases comprising the at least one indicator gas;

detecting the second portion of the optical beam after the second portion has passed through the reference volume of gases;

based on the detected first and second portions of the optical beam, controllably changing an output frequency of the laser source to substantially correspond with an absorption line of the at least one indicator gas;

determining a real-time concentration of the at least one indicator gas based on the detected first and second portions of the optical beam;

determining a process time for degassing, based on the real-time concentration; and re-pressurizing the melt chamber upon completion of the process time.

2. The method of claim 1, wherein the first portion of the optical beam is detected by an optical detector.

3. The method of claim 2, wherein the first portion of the optical beam is focused on receiving optics, and wherein the optical detector is remotely positioned and operably connected to the receiving optics via an optical connector.

4. The method of claim 2 or claim 3, further comprising reflecting the first portion of the optical beam across the volume of gases one or more times.

5. The method of claim 1 or claim 2, further comprising extracting the volume of gases evolved from the melt chamber into an external cell prior to detection.

6. The method of claim 5, further comprising reflecting the first portion of the optical beam across the volume of gases one or more times.

7. The method of claim 2, wherein the first portion of the optical beam is detected using non-dispersive infrared sensing.

8. The method of claim 2, wherein the first portion of the optical beam is detected using Fourier transform infrared spectrometry.

9. The method of claim 1, wherein the volume of gases is in a vacuum pump exhaust at ambient pressure.

10. The method of claim 1, further comprising:

disabling the laser source to measure background radiation; and compensating for the measured background radiation.

11. The method of claim 1, wherein the optical beam is substantially in the near infrared wavelengths.

12. The method of claim 1, wherein the optical beam is substantially in the mid infrared wavelengths.

13. The method of claim 1, further comprising detecting a change in the real-time concentration corresponding to a predetermined profile indicative of a process control problem.

14. The method of claim 13, wherein the process control problem is stirring gas injection nozzle clogging.

* * * * *